US005984218A

United States Patent [19]

Peat

[11] Patent Number: 5,984,218

[45] **Date of Patent: *Nov. 16, 1999**

[54] PORTABLE MIXER WITH ROUGHAGECUTTING AUGER

[75] Inventor: Robert W. Peat, Garden City, Kans.

[73] Assignee: Heyco, Inc., Garden City, Kans.

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,861

[22] Filed: Sep. 11, 1997

Related U.S. Application Data

[63] Continuation of application No. 08/630,161, Apr. 10, 1996, abandoned.

[51] Int. Cl.[6] ..... B02C 19/22

[52] U.S. Cl. ..... 241/260.1; 241/294

[58] Field of Search ..... 241/260.1, 291, 241/294, 605; 366/81, 90, 324

[56] References Cited

U.S. PATENT DOCUMENTS

| | | | |
|---|---|---|---|
| 2,240,720 | 5/1941 | Selhorst . | |
| 2,284,549 | 5/1942 | Yablonski . | |
| 2,656,122 | 10/1953 | Borner | 241/260.1 |
| 4,182,592 | 1/1980 | Henryson . | |
| 4,253,615 | 3/1981 | Koenig . | |
| 4,344,580 | 8/1982 | Hoshall et al. | 241/260.1 X |
| 4,580,733 | 4/1986 | Nakagomi | 241/260.1 X |
| 4,929,086 | 5/1990 | Geyer . | |
| 5,148,999 | 9/1992 | Curfman et al. . | |
| 5,433,577 | 7/1995 | Roycraft . | |
| 5,443,588 | 8/1995 | Loppoli | 241/260.1 X |

FOREIGN PATENT DOCUMENTS

| | | | |
|---|---|---|---|
| 2644365 | 9/1990 | France | 241/260.1 |
| 5-49963 | 3/1993 | Japan | 241/186.5 |

*Primary Examiner*—Mark Rosenbaum
*Attorney, Agent, or Firm*—Shook, Hardy & Bacon LLP

[57] ABSTRACT

A portable mixer has a bin with a number of augers rotatably mounted therein. The augers have forward flights, for conveying roughage feed material, such as hay, in a forward direction, and reverse flights, for conveying the feed materials in an opposite direction. The augers mix feed material introduced into the bin and convey the feed material to a discharge opening. At least one of the augers has a ribbon flighting positioned at an outer peripheral edge of the auger flighting. The ribbon flighting has an outer edge having a continuous saw-tooth cut. The relatively small, closely spaced teeth of the saw-tooth edge cuts the elongated fibrous material, such as hay, without increasing the torque required by the auger. The ribbon flighting is formed from a number of separate, identical ribbon flighting members positioned in series along the outer peripheral edge of the auger flighting.

13 Claims, 1 Drawing Sheet

PORTABLE MIXER WITH ROUGHAGECUTTING AUGER

This is a continuation of application Ser. No. 08/630,161, filed Apr. 10, 1996, now abandoned.

BACKGROUND OF THE INVENTION

1. Field of the Invention

The present invention is directed to a portable or permanent mixer for mixing animal feed or roughage. More particularly, the present invention is directed to an auger for use in a portable mixer. More specifically, the present invention is directed to a ribbon flighting, adapted to be attached proximate an outer peripheral edge of an auger, for cutting fibrous feed material, such as hay.

2. Description of the Related Art

Mixers for mixing animal feed or roughage, such as hay and the like, are well-known. Such mixers generally include a bin having one or more augers located within the bin for mixing the feed materials and, at the same time, conveying the feed materials from an inlet portion of the bin to a discharge outlet opening of the bin. Typically, the orientation of the augers is such that the mixed feed is conveyed to an outlet opening in the side of the bin so that the mixed feed can be discharged by continuing rotation of the augers. As set forth in U.S. Pat. No. 5,148,999, which discloses an animal feed mixing system of the type having a bin with augers, various elongated fibrous materials, such as hay or cornstalks, often present problems for traditional mixing systems. The fibrous material tends to become clogged about the auger, thus increasing the torque required by the drive assembly, coupled to the rotatably mounted auger, for driving the auger.

In order to overcome the problems associated with mixing and conveying fibrous materials, such as hay and the like, numerous attempts have been made at placing cutting blades at the outer peripheral edge of the augers In this regard, it is highly desirable to cut the elongated fibrous materials into finer pieces for both the purpose of enhancing the mixing operation, as well as reducing clogging and the amount of torque to which the rotational augers are subjected. U.S. Pat. No. 5,148,999 shows one approach in which outer edges of the auger flight include inserts having cutting edges positioned at various spaced locations. The inserts co-act with the sides of the mixer to cut and chop fibrous material. This approach, and others like it, requires substantially modifying the outer peripheral edge of an auger flighting, thereby increasing the overall complexity and expense of the auger.

Prior art devices, having cutting blades at spaced locations along the peripheral edge of an auger flight, typically utilize blades having a tooth size of around one inch (1") or larger Those prior art devices utilizing spaced teeth of one inch, or larger, have a limited number of teeth per 180° of auger flighting. As a result, these prior art devices have a limited number of blade contact areas. Additionally, the utilization of large, spaced teeth tends to cause the fibrous material to load up, thereby increasing the torque loads required by the auger. In some cases, a sickle knife has been used which provides a sharper cutting edge, but tends to break because of the elongated, thin nature of the knife.

Accordingly, the need exists for a simple, inexpensive auger for cutting and mixing fibrous material. Specifically, the need exists for an auger which tends to maximize the cutting contact area about the auger flighting. The need also exists for an auger which increases the cutting action accomplished by the auger, without increasing the torque to which the auger is subjected. Additionally, the need exists for a device which may be easily retrofit onto certain existing augers. The present invention fills these and other needs, and overcomes the drawbacks of the prior art.

SUMMARY OF THE INVENTION

It is an object of the present invention to provide an inexpensive auger for cutting and mixing fibrous feed material.

It is an object of the present invention to continuously cut feed materials with an auger without substantially increasing the torque to which the auger is subjected.

It is an object of the present invention to satisfy the need for an inexpensive auger which enhances the cutting and conveying of fibrous feed material.

It is an additional primary object of the present invention to assist in the processing, mixing, and conveying of long fiber roughage livestock feed materials.

These and other objects are achieved by a portable mixer having a bin with a number of augers therein. The mixing bin is mounted on a trailer or truck. Each auger has forward flights tending to convey fibrous material in a forward direction, and reverse flights tending to convey the fibrous material in a reverse direction, opposite the forward direction. The fibrous materials are introduced into the bin at its open top, and the augers are rotated to convey and mix the fibrous material to a discharge opening located at a bottom, side portion of the bin.

In accordance with a principal aspect of the present invention, at least one auger has a ribbon flighting attached about its outer periphery. The ribbon flighting has a plurality of adjacent, closely spaced teeth forming a saw-tooth cutting edge for cutting the fibrous material into which it comes in contact. The teeth of the ribbon flighting are less than one inch in height and, preferably, are approximately ⅜ of an inch in height. The ribbon flighting is attached to the outer peripheral edge of the auger flights by weldements or fasteners, such as rivets or bolts. In one preferred embodiment, the ribbon flighting is positioned only on the forward flights of the augers. In operation, when the augers are rotated, the saw-toothed cutting edge of the ribbon flighting forms a continuous cutting edge, for cutting through the fibrous material. Utilization of the present invention has been found to substantially increase mixing, while not substantially increasing the torque required by the augers.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 2:
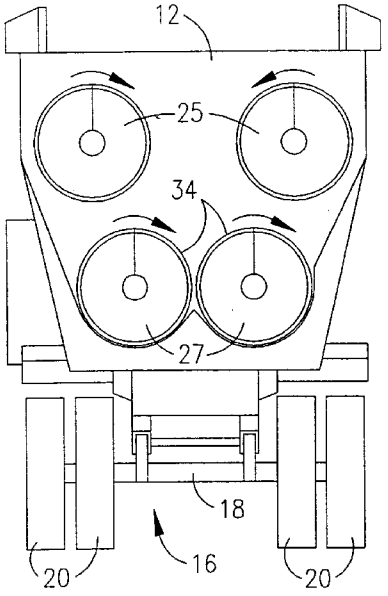
FIG. 2 is a rear end view, taken along line 2—2 of FIG. 1, of the mixer of the present invention.
Figure 1:
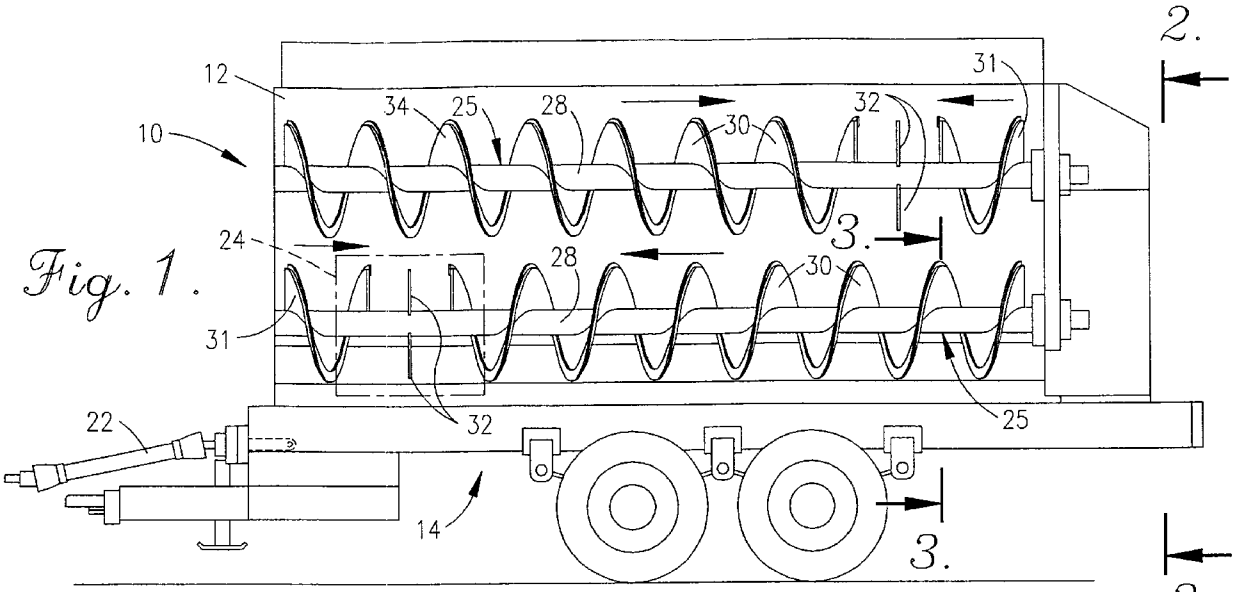
FIG. 1 is a side elevational view of a mixer of the present invention.

With reference initially to FIGS. 1 and 2, a portable mixer of the present invention is denoted generally by reference numeral 10. It should be understood that a portable mixer has been shown for illustrative purposes, but that the mixer could be a permanent mixer, if desired, The mixer 10 has a large bin 12 positioned on a trailer 14. it will be readily appreciated that the portable mixer 10 of the present invention has a bin that may be located on a truck bed, rather than a trailer which is shown for illustrative purposes. Trailer 12 has conventional components such as an undercarriage 16, axle(s) 18, and wheels 20. A power take-off 22 is for connection with the power take-off of a tractor or other vehicle, for rotatably mounting a drive assembly (not shown), which in turn rotates augers 25.

As shown in FIGS. 1 and 2, the bin 12 preferably has four augers 25 rotatably mounted between first and second ends of the bin 12. It will be understood that, during operation, roughage and other feed materials, including elongated fibrous materials such as hay stalks and the like, are introduced into bin 12 through an open upper end of bin 12. The rotating augers 25 mix the roughage and convey it from an upper portion of bin 12, generally in the direction of the arrows, to a lower portion of bin 12 where it is discharged from discharge opening 24 positioned in a lower side portion of bin 12. As shown in FIG. 2, the upper augers are rotated in opposite directions, while the lower augers are rotated in the same direction. It will be appreciated that the direction of rotation of augers 25 is a matter of preference, and that the augers may be generally rotated as desired, so long as the general purpose of mixing and conveying the feed materials is accomplished. As shown, and as is conventional on modern-day mixing bins, each auger has a central shaft 28 with forward flights 30 for conveying feed material in a generally forward direction, as indicated by the directional arrows in FIG. 3, and one or more reverse flights 31, for generally conveying feed material in a reverse direction, opposite the forward direction, as generally shown by the arrows in FIG. 1. Additionally, it is preferred that each auger 25 have one or more cutting blades 32 positioned at a location for separating the forward flights 30 from the reverse flights 31.

Figure 3:
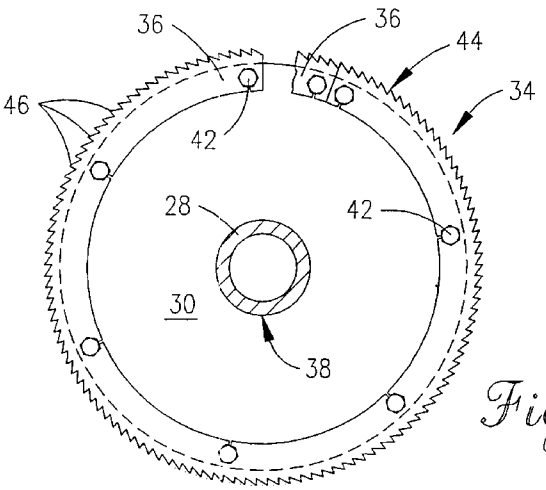
FIG. 3 is a cross-sectional view taken along line 3—3 of FIG. 1.

In accordance with a principal aspect of the present invention, one or more of the flights 30, 31 have a ribbon flighting 34 positioned thereon. Specifically, as illustrated in FIG. 3, showing a cross-section of one of the forward flights 30 of auger 25, an inner peripheral edge 38 of forward flight 30 is positioned about, and connected to, central shaft 28 of auger 25. A ribbon flighting 34 is positioned about an outer peripheral edge 40 of flight 30 of auger 25. Ribbon flighting 34 is fastened to the auger flight 30 in any conventional manner, such as by weldements or fasteners 42. It will be appreciated that, when weldements are utilized, weldements may be positioned about ribbon flighting 34 at any convenient location. As shown in FIG. 3, evenly spaced fasteners 42 are positioned through apertures (not shown) in the ribbon flighting 34, and also through the auger flight 30, for securely, but detachably, connecting ribbon flighting 34 proximate the outer peripheral edge 28 of auger flight 30. Fasteners 42 may comprise any conventional fastener, such as bolts, rivets, or the like.

As shown, ribbon flighting 34 is preferably comprised of a number of ribbon flighting members 36. Each ribbon flighting member 36 of the overall ribbon flighting 34 is preferably made of an abrasion-resistant plate steel. Each ribbon flighting member is preferably adapted to travel approximately ten inches about one flight 30 (or 31). In this way, successive ribbon flighting members 36 are positioned in series, adjacent each other, so as to, in a preferred embodiment, travel along the entirety of the outer peripheral edge 40 of the flighting of an auger. It will be understood that ribbon flighting members 36 may be formed of any suitable length. It will also be understood that, if desired, ribbon flighting members 36 may be spaced apart. Specifically, in a preferred embodiment of the present invention, ribbon flighting 34 is positioned along the entirety of forward flights 30, but not on reverse flights 31. It will, of course, be understood that reverse flights 31 could also include one or more ribbon flighting members 36.

Figure 4:
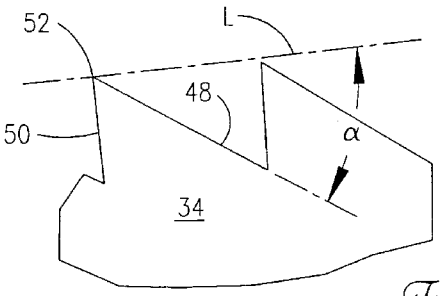
FIG. 4 is an enlarged fragmentary view showing a portion of the cutting teeth of the ribbon flighting of the present invention.

Each ribbon flighting member 36 has a continuous saw-toothed cut 44, comprised of a number of closely spaced teeth 46, along its outer peripheral edge. As shown in FIG. 4, each tooth 46 preferably has a trailing edge 48 and a leading edge 50, intersecting at an upper end in an outer extending point 52. Trailing edge 48 is preferably angled, at an angle a of approximately 34° from an imaginary line "L" drawn tangentially to the ribbon flighting member 36 at point 48. Leading edge 50 is preferably generally perpendicular to the stated imaginary tangential line. As shown, the leading edge 50 of a first tooth 46 intersects at a lower end thereof with the lower end of the trailing edge 48 of the next adjacent tooth 48. This lower point of intersection is on a circumference corresponding to a base of the tooth 46. In accordance with the principles of the present invention, each tooth 46 is identical in size and shape to all other teeth 46, and is less than one inch in height. More specifically, each tooth is preferably approximately ⅜ of an inch in height. In an alternate embodiment, the saw-tooth cut 44 may be formed directly in the outer peripheral edge of the auger flight 30 (or 31).

In operation, the auger 25 of the present invention and, particularly, the ribbon flighting 34 of the present invention provides a highly useful device for cutting and mixing roughage, including elongated fibrous material such as hay. The continuous saw-toothed cutting edge 44, as well as the size and dimension of the teeth 46, provide continuous cutting action without increasing the torque required by auger 25. The utilization of abrasion-resistant steel for flighting 34 serves to protect the main auger flights upon which it is used. Additionally, ribbon flighting members 36 are inexpensive to manufacture, and are also easily installed and replaced.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An auger comprising:

an elongated, rotatable central shaft;

an auger flight having an inner peripheral edge joined to said central shaft and an outer peripheral edge forming a helix, said auger flight having a pushing surface and a trailing surface; and a ribbon flighting formed separately from said auger flight, said ribbon flighting being disposed on one of said surfaces proximate said outer peripheral edge of said auger flight, said ribbon flighting including an outer circumferential edge having an at least substantially continuous tooth-cut extending radially of said shaft and outwardly of said helix, said ribbon flighting being detachably mounted on said one of said surfaces, whereby upon being detached it is able to move axially of said shaft away from said one of said surfaces to thereby facilitate repair or replacement.

2. The auger, as set forth in claim 1, wherein said auger flight is a forward flight, said central shaft further having a reverse flight, wherein said ribbon flighting is positioned on said forward flight, but not on said reverse flight.

3. The auger, as set forth in claim 1, wherein said tooth cut is a saw-toothed cut comprised of a plurality of adjacent teeth, extending outwardly from said ribbon flighting, wherein each said tooth terminates at an outer end in an outwardly extending point.

4. The auger, as set forth in claim 3, wherein each said tooth is less than one inch in height.

5. The auger, as set forth in claim 4, wherein each said tooth is approximately ⅜-inch in height.

6. The auger, as set forth in claim 5, wherein each said tooth has a trailing edge angled between 30° and 40° with respect to an imaginary line drawn tangentially to said ribbon flighting at said point of said tooth.

7. The auger, as set forth in claim 6, wherein each said tooth has a leading edge aligned substantially perpendicularly to said imaginary line drawn tangentially to said ribbon at said tooth.

8. The auger, as set forth in claim 7, wherein said trailing edge is angled at approximately 34° with respect to said imaginary tangential line.

9. The auger, as set forth in claim 1, wherein said ribbon flighting is comprised of a plurality of identical ribbon flighting members, each said ribbon flighting member being releasably secured proximate said outer peripheral edge of said auger flight.

10. A mixer for mixing feed material, said mixer comprising:

a bin;

an auger having an elongated, rotatable central shaft, said auger being rotatably mounted in said bin;

an auger flight, having an inner peripheral edge joined to said central shaft and an outer peripheral edge forming a helix, said auger flight having a pushing surface and a trailing surface; and a ribbon flighting formed separately from said flight, said ribbon flighting being disposed on one of said surfaces proximate said outer peripheral edge of said auger flight, said ribbon flighting including an outer circumferential edge having an at least substantially continuous tooth-cut extending radially of said shaft and outwardly of said helix, said ribbon flighting being detachably mounted on said one of said surfaces, whereby upon being detached it is able to move axially of said shaft away from said one of said surfaces to thereby facilitate repair or replacement.

11. The mixer, as set forth in claim 10, said ribbon flighting having a plurality of cutting teeth thereon, wherein said teeth are each less than ½-inch in height.

12. The mixer, as set forth in claim 10, said ribbon flighting having a plurality of cutting teeth thereon, wherein each said tooth of said plurality of teeth has a trailing edge angled downwardly at an angle of less than 50° from an imaginary line tangent to an outer point of said tooth.

13. A mixer, as set forth in claim 12, wherein each said tooth has a leading edge oriented substantially perpendicular to said tangential line.

* * * * *